United States Patent [19]

Kleinberg

[11] Patent Number: 4,702,757

[45] Date of Patent: Oct. 27, 1987

[54] DUAL AIR PRESSURE CYCLE TO PRODUCE LOW PURITY OXYGEN

[75] Inventor: William T. Kleinberg, Breinigsville, Pa.

[73] Assignee: Air Products and Chemicals, Inc., Allentown, Pa.

[21] Appl. No.: 898,280

[22] Filed: Aug. 20, 1986

[51] Int. Cl.[4] ..... F25J 3/02

[52] U.S. Cl. ..... 62/24; 62/32; 62/43

[58] Field of Search ..... 62/11, 23, 24, 32, 42, 62/43

[56] References Cited

U.S. PATENT DOCUMENTS

| | | | |
|---|---|---|---|
| 3,210,951 | 10/1965 | Gaumer | 62/29 |
| 3,277,655 | 10/1966 | Geist et al. | 62/29 |
| 3,327,489 | 6/1967 | Gaumer | 62/29 |
| 3,754,406 | 8/1973 | Allam | 62/41 |
| 3,763,658 | 10/1973 | Gaumer, Jr. et al | 62/11 |
| 4,433,989 | 2/1984 | Erickson | 62/42 |
| 4,464,191 | 8/1984 | Erickson | 62/42 |
| 4,615,716 | 10/1986 | Cormier et al. | 62/24 |
| 4,617,036 | 10/1986 | Suchdeo et al. | 62/42 |
| 4,617,037 | 10/1986 | Okada et al. | 62/11 |

*Primary Examiner*—Ronald C. Capossela

*Attorney, Agent, or Firm*—Willard Jones, II; James C. Simmons; E. Eugene Innis

[57] ABSTRACT

In a process utilizing high and low pressure distillation columns for the production of an oxygen-enriched air product, feed air is fed to the main heat exchangers at two pressures. The high pressure feed air from the main exchanger used to supply refrigeration, by expanding a portion of the high pressure air prior to introducing that portion into an intermediate location in the low pressure column, and to vaporize the oxygen-enriched air product prior to using the stream as reflux for the high pressure column. The low pressure feed air from the main heat exchangers is partially condensed to supply reboiler duty to a low pressure column and is then fed to a high pressure column. The high pressure column condenser is used to reboil an intermediate liquid in the low pressure column.

5 Claims, 1 Drawing Figure

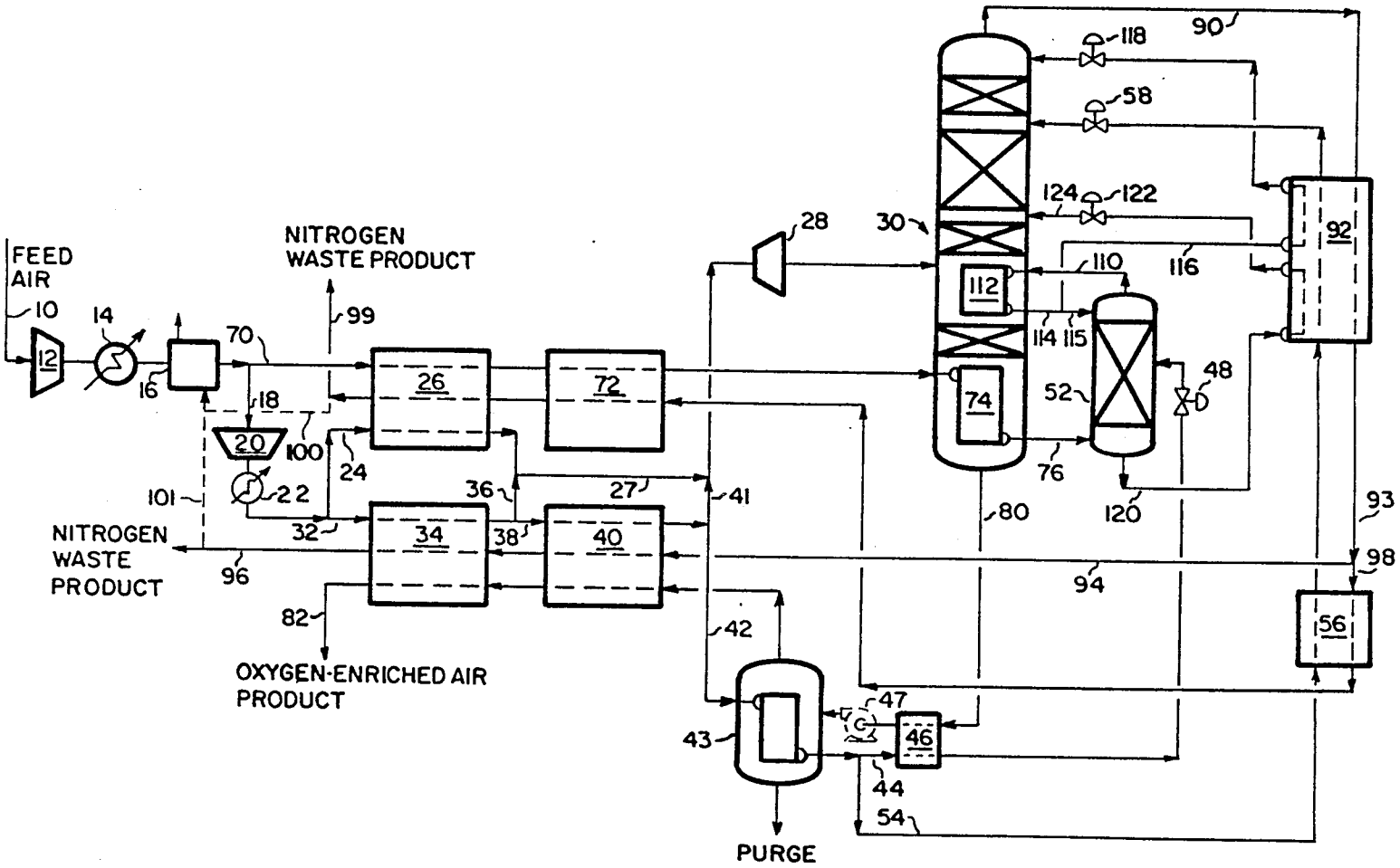
FEED AIR
NITROGEN WASTE PRODUCT
NITROGEN WASTE PRODUCT
OXYGEN-ENRICHED AIR PRODUCT
PURGE

DUAL AIR PRESSURE CYCLE TO PRODUCE LOW PURITY OXYGEN

TECHNICAL FIELD

The present invention relates to the separation of air into its constituent parts by distillation of the feed air in two distillation columns operating at different pressures.

BACKGROUND OF THE INVENTION

Several processes have been used commercially or have been proposed to produce an oxygen-enriched air product by fractionation of air into its constituent components.

In U.S. Pat. No. 3,210,951, a fractionation cycle employing first and second fractionating zones operating under different pressures and including two reboiler/condensers is disclosed. Both of the reboiler/condensers are interconnected with the stages of fractionation in such a manner as to effect the required reboil and reflux production with minimum pressure differential between the stages of rectification and also decrease the irreversibility of the overall fractionation process thereby obtaining the desired separation with the high pressure stage operating under substantially reduced pressure.

In U.S. Pat. No. 3,277,655, an improvement to the fractionation process taught in U.S. Pat. No. 3,210,951 is disclosed. In this process, the heat exchange occurring in one of the two reboiler/condensers between the bottoms liquid from the lower pressure column and the gaseous material from the high pressure column results in complete liquefaction of the liquid from the low pressure column thereby satisfying the reboiler requirements of the low pressure column. Additionally, when the liquefied gaseous material from the high pressure column is introduced into the lower pressure column it improves the reflux ratio in the upper portion of the low pressure column which increases the separation efficiency and makes it possible to lower the pressure of the gaseous mixture entering the cycle.

In U.S. Pat. No. 3,327,489, another improvmeent to U.S. Pat. No. 3,210,951 to lower the pressure in the high pressure fractionator is disclosed. In the process, the pressure reduction is obtained along with the associated power reduction by establishing a heat exchange between gaseous material, which may comprise the feed mixture, and a liquid component collecting in the bottom of the low pressure fractionator, with the liquid component being under different pressure.

In U.S. Pat. No. 3,754,406, a process is disclosed for the production of low purity oxygen, in which a low pressure stream of incoming air is cooled against outgoing gas streams and fed into a high pressure distillation column. A high pressure stream of incoming air is cooled against outgoing gas stream, partially condensed against boiling oxygen product in a product vaporizer, and separated into gas and liquid streams. The liquid stream being subcooled and expanded into a low pressure fractionating column. The gas stream is reheated and expanded to provide process refrigeration and is introduced into the low pressure fractionating column. Crude liquid oxygen from the bottom of the high pressure column is cooled and introduced into the low pressure column after being used to liquefy some of the nitrogen from the high pressure column in an external reboiler condenser. Liquid oxygen produced from the low pressure column is pumped to a higher pressure before being passed to the subcooler and the product vaporizer. The remainder of the high pressure nitrogen is liquefied in a second external reboiler/condenser and is used as reflux for the two columns. A waste nitrogen stream is removed from the low pressure column.

BRIEF SUMMARY OF THE INVENTION

A process for the production of oxygen-enriched air by the fractionation of air in a double distallation column having a high pressure and low pressure column is disclosed. In the process, a feed air stream is compressed and split into a first feed air stream and a second feed air stream. The first air stream is further compressed prior to being split into a first and second substream and having both substreams cooled. The first substream is then combined with at least a portion of the second substream and expanded prior to being introduced into an intermediate location of the low pressure column.

The remaining portion of said second substream is further cooled and condensed. At least a portion of the condensed second substream is fed to the high pressure column; the remaining portion of the condensed second substream is subcooled and reduced in pressure prior to being introduced in the low pressure column as reflux.

The second feed air stream is cooled and fed to a reboiler in a lower portion of the low pressure column, thereby partially condensing the second feed air stream. The partially condensed second feed air stream is then fed to the high pressure column.

An overhead stream is withdrawn from the top of said high pressure column and condensed in an intermediate reboiler located in the low pressure column. At least a portion of the condensed overhead is subcooled and reduced in pressure prior to being introudced into the top of the high pressure column as reflux. The remaining condensed overhead is fed to the top of the low pressure column as reflux.

A bottoms liquid stream is removed from the high pressure column, subcooled and reduced in pressure prior to being introduced into the low pressure column as an intermediate reflux;

A nitrogen waste product is removed as an overhead from the low pressure fractionation section and warmed against other process streams to recover refrigeration. A liquid oxygen-enriched air stream is withdrawn from the low pressure column, warmed and vaporized.

BRIEF DESCRIPTION OF THE DRAWING

The single FIGURE of the drawing is a schematic diagram of the process of the present invention.

DETAILED DESCRIPTION OF THE INVENTION

Referring to the single figure of the drawing, air enters the plant, via line 10, is compressed in compressor 12, aftercooled in exchanger 14, has had any impurities which would freeze out in the process, e.g. water and carbon dioxide, removed in adsorber 16 and split into two streams, a first feed air stream (line 18) and a second feed air stream (line 70). Alternate means for removing impurities, e.g. reversing heat exchangers, can be utilized in the present invention as a replacement for the adsorber. The first feed air stream in line 18 is further compressed in compressor 20, aftercooled in heat exchanger 22 and is split into two substreams, lines 24 and 32. The first substream, line 24, is cooled in heat exchanger 26. The second substream, line 32, is cooled in heat exchanger 34. A portion of the second substream is combined, via line 36, with the first substream, line 24, to form combined stream 27. The remainder of the second substream, now in line 38, is further cooled and another portion is withdrawn and combined with combined stream 27, via line 41, the entire stream is then expanded in expander 28 to recover refrigeration and fed to an intermediate location of low pressure column 30. The remaining portion of the second substream is fed, via line 42, to oxygen product vaporizer 43 where it is condensed. This condensed feed air stream is removed from vaporizer 42; a portion of this liquefied second substream is removed, via line 44, cooled in heat exchanger 46, reduced in pressure in J-T valve 48 and fed to an intermediate location of high pressure column 52. The remainder of liquefied substream from vaporizer 43, in line 54, is subcooled in heat exchangers 56 and 92, reduced in pressure in J-T valve 58 and fed to low pressure column 30 as an intermediate reflux.

The second feed air stream in line 70 is cooled in heat exchangers 26 and 72, fed to reboiler 74, located in the bottom portion of low pressure distillation column 30, wherein it is partially condensed thereby providing reboiler duty to low pressure column 30 and then fed to the bottom of high pressure column 52, via line 76.

A liquid bottoms stream is removed from the high pressure column 52, via line 120, cooled in exchanger 92, and reduced in pressure in J-T valve 122, prior to being fed to an intermediate location of the low pressure column 30, via line 124.

The overhead vapor from high pressure column 52, removed via line 110 is condensed in intermediate reboiler 112 located in low pressure column 30 and removed from intermediate reboiler 112 via line 114. This liquefied overhead in line 114 is split into two portions. A first portion, via line 116 is subcooled in heat exchanger 92 and reduced in pressure in J-T valve 118 prior to being introduced as reflux to the top of low pressure column 30. The second portion is returned, via line 115, to the top of high pressure column 52 as reflux.

A nitrogen waste stream is removed, via line 90, from the top of low pressure column 30 and warmed in heat exchanger 92. This nitrogen waste stream, now in line 93, is split into two nitrogen waste substreams, lines 94 and 98. The first waste substream, in line 98, is warmed in heat exchangers 56, 72 and 26. The warmed first nitrogen waste substream, in line 98, is then vented to the atmosphere via line 99. The second nitrogen substream, line 94, is warmed in heat exchangers 40 and 34. The warmed second nitrogen substream is vented to the atmosphere via line 96. Optionally, a small portion of either nitrogen waste substream, streams 96 and 99, as shown by dashed lines 100 and 101, can be used to regenerate adsorber 16.

A liquid oxygen-enriched product stream is removed from the bottom of the low pressure column 30, via line 80. This liquid oxygen-enriched stream, in line 80, is warmed in heat exchanger 46 and vaporized in vaporizer 43. Optionally, the liquid oxygen-enriched product stream can be pumped with pump 47 to a higher pressure prior to vaporiztion, thereby increasing the pressure of the gaseous product. The gaseous oxygen-enriched stream is removed from vaporizer 43, warmed in heat exchangers 40 and 34, and removed from the process as an oxygen enriched gaseous product, via line 82.

The optimum product purity for the prsent invention, which produces an oxygen-enriched air, is approximately 70% by volume. As an example, for the production of this 70% by volume oxygen-enriched product in the present invention, ambient air is compressed in compressor 12 to about 40 psia. The first feed air stream in line 18, which is about 55.3 mol % of the total feed air, is further compressed in compressor 20 to 63 psia and is split into two substreams, lines 24 and 32. The first substream, line 24, which comprises about 6.6 mol % of the first feed air stream, is cooled in heat exchanger 26 to about −173° F. The second substream, line 32, which comprises about 93.4 mol % of the first feed air stream, is cooled in heat exchanger 34 to about −173° F. A portion, about 2.6 mol %, of the second substream is combined, via line 36, with the first substream, line 24, to form combined stream 27. The remainder of the second substream, now in line 38, is further cooled to −287° F. and another portion, about 36.1 mol % of the second substream, is withdrawn and combined with combined stream 27, via line 41, this entire stream is then expanded to 20 psia and fed to an intermediate location of low pressure column 30. The remaining portion, about 61.3 mol %, of the second substream is fed, via line 42, to oxygen product vaporizer 43 where it is condensed. This condensed feed air stream is removed from vaporizer 43; a portion, about 29.7 mol %, of this liquefied second substream is removed, via line 44, cooled in heat exchanger 46 to −300° F., reduced in pressure to 34 psia and fed to an intermediate location of high pressure column 52. The remainder, about 70.3 mol %, of liquefied substream, in line 54, is subcooled in heat exchanger 56 and 92 to −312° F., reduced in pressure to 19 psia in J-T valve 58 and fed to low pressure column 30 as an intermediate reflux.

The second feed air stream in line 70 is cooled in heat exchangers 26 and 72 to −290° F., fed to reboiler 74, wherein it is partially condensed thereby providing reboiler duty to low pressure column 30 and then fed to the bottom of high pressure column 52.

A liquid bottoms stream is removed, via line 120, from the high pressure column 52, cooled in exchanger 92 to −305° F., and reduced in pressure in J-T valve 118 to 19 psia, prior to being fed to an intermediate location of the low pressure column 30.

A nitrogen waste stream is removed, via line 90, from the top of low pressure column 30 and warmed in heat exchanger 92. This nitrogen waste stream, now in line 93, is split into two nitrogen waste substreams, lines 94 and 98. The first nitrogen waste substream, in line 98, is warmed in heat exchangers 56, 72 and 26. The warmed first nitrogen waste substream, in line 98, is then vented to the atmosphere via line 99. The second nitrogen substream, line 94, is warmed in heat exchangers 40 and 34. The warmed second nitrogen substream is vented to the atmosphere via line 96.

A liquid oxygen-enriched product stream is removed from the bottom of the low pressure column 30, via line 80. This liquid oxygen-enriched stream, in line 80, is warmed in heat exchanger 46 and vaporized in vaporizer 42. The gaseous oxygen-enriched stream is removed from vaporizer 42, warmed in heat exchangers 40 and 34, and removed from the process as an oxygen-enriched gaseous product at 21.5 psia.

On the basis of 150 MSCFH contained oxygen of a 70% by volume oxygen, oxygen-enriched air product, the energy requirements for the present invention is approximately 1650 hp, this represents a 4.5% reduction in the energy requirements for the process disclosed in U.S. Pat. No. 3,754,406. A 4.5% reduction in the energy requirements for an air separation process is considered to be a significant reduction.

The present invention has been described with reference to a specific embodiment thereof. This embodiment should not be considered a limitation on the scope of the present invention, such limitations on the scope of the present invention being ascertained by the following claims.

What is claimed is:

1. A process for the production of oxygen-enriched air by the fractionation of air in a double distillation column having high pressure and low pressure columns, which comprises the steps of:

(a) compressing a feed air stream and splitting said feed air stream into a first feed air stream and a second feed air stream;

(b) compressing the first feed air stream, prior to splitting said first feed air stream into a first and second substream;

(c) cooling said first substream and second substream;

(d) combining said first substream with at least a portion of said second substream, thus forming a combined low pressure column feed stream and leaving a first remaining portion of the second substream, and expanding said combined low pressure column feed stream prior to being introduced into an intermediate location of the low pressure column;

(e) condensing said first remaining portion of the second substream, thus producing a condensed first remaining portion of the second substream;

(f) subcooling, reducing in pressure and feeding at least a portion of said condensed first remaining portion of the second substream to the high pressure column, thus leaving a condensed second remaining portion of the second substream, subcooling and reducing in pressure the condensed second remaining portion of the second substream prior to being introduced in the low pressure column as reflux;

(g) cooling and then feeding said second feed air stream to a reboiler in a lower portion of the low pressure column, thereby partially condensing said second feed air stream, thus producing a partially condensed second air feed stream;

(h) feeding said partially condensed second feed air stream to the high pressure column;

(i) removing an overhead stream from the top of said high pressure column, condensing said overhead stream in an intermediate reboiler located in the low pressure column, subcooling and reducing in pressure at least a portion of the overhead prior to introducing it into the top of the low pressure column as reflux, and feeding the remaining overhead into the top of the high pressure column as reflux;

(j) removing a bottoms liquid stream from the high pressure column, subcooling and reducing in pressure said bottoms liquid stream prior to being introduced into the low pressure column as an intermediate relux; and (k) removing a liquid oxygen-enriched air stream from the low pressure column, and warming and vaporizing said liquid oxygen-enriched air stream.

2. The process of claim 1 which further comprises pumping said liquid oxygen-enriched air stream to a higher pressure prior to vaporization.

3. The process of claim 1 which further comprises removing in an adsorber any impurities which would freeze in the process from the compressed feed air stream.

4. The process of claim 3 wherein a nitrogen waste stream is removed from the low pressure distillation column which further comprises utilzing at least a portion of said nitrogen waste stream to regenerate the adsorber.

5. The process of claim 1 which further comprises removing in a reversing heat exchanger any impurities which would freeze in the process from the compressed feed air stream.

* * * * *